US006694774B1

(12) United States Patent
Rashad et al.

(10) Patent No.: US 6,694,774 B1
(45) Date of Patent: Feb. 24, 2004

(54) GAS LIQUEFACTION METHOD USING NATURAL GAS AND MIXED GAS REFRIGERATION

(75) Inventors: M. Abdul-Aziz Rashad, Kenmore, NY (US); Richard C. Fitzgerald, Grand Island, NY (US); Dante Patrick Bonaquist, Grand Island, NY (US); John B. Saunders, Grand Island, NY (US); Minish Mahendra Shah, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/357,348

(22) Filed: Feb. 4, 2003

(51) Int. Cl.[7] ..... F25J 1/00
(52) U.S. Cl. ..... 62/612; 62/611
(58) Field of Search ..... 62/611, 612, 613

(56) References Cited

U.S. PATENT DOCUMENTS

| | | | | | |
|---|---|---|---|---|---|
| 3,182,461 | A | | 5/1965 | Johanson | 62/13 |
| 3,360,944 | A | | 1/1968 | Knapp et al. | 62/12 |
| 3,608,323 | A | | 9/1971 | Salama | 62/9 |
| 3,792,590 | A | | 2/1974 | Lofredo et al. | 62/38 |
| 4,911,741 | A | * | 3/1990 | Davis et al. | 62/611 |
| 6,041,620 | A | | 3/2000 | Olszewski et al. | 62/612 |
| 6,131,407 | A | | 10/2000 | Wissolik | 62/606 |
| 6,158,240 | A | * | 12/2000 | Low et al. | 62/611 |
| 6,196,021 | B1 | * | 3/2001 | Wissolik | 62/606 |
| 6,269,656 | B1 | * | 8/2001 | Johnston | 62/613 |
| 6,289,692 | B1 | * | 9/2001 | Houser et al. | 62/613 |
| 6,412,302 | B1 | * | 7/2002 | Foglietta | 62/611 |
| 6,427,483 | B1 | | 8/2002 | Rashad et al. | 62/613 |

* cited by examiner

*Primary Examiner*—William C. Doerrler
(74) *Attorney, Agent, or Firm*—Stanley Ktorides

(57) ABSTRACT

A gas liquefaction method which uses the pressure energy of a natural gas processing system to generate refrigeration for high temperature cooling of a gas, and uses a mixed gas refrigerant fluid to generate refrigeration for low temperature cooling of the gas to produce liquefied product.

17 Claims, 3 Drawing Sheets

GAS LIQUEFACTION METHOD USING NATURAL GAS AND MIXED GAS REFRIGERATION

TECHNICAL FIELD

This invention relates generally to natural gas processing and to mixed gas refrigeration systems.

BACKGROUND ART

Natural gas transmission pipelines are typically operated under a very high pressure, which can range between 200 to 1000 pounds per square inch gauge (psig). At various locations all over the pipeline network, known as let-down stations, this high pressure gas is throttled down to a lower pressure which is more suitable for its end-use. This low pressure will typically range between 40 to 80 psig. The throttling action of the gas can actually reduce the gas temperature to below 32° F. and hence pipe-freezing and frost formation is a problem that has to be avoided. A standard solution takes a small fraction of the natural gas and burns it to produce hot gas which is then directed on to the pipe surface to prevent freezing. As a result, the free pressure energy available from letting down the gas pressure is typically not utilized in any useful form.

Accordingly it is an object of this invention to provide a method for gainfully employing pressure energy found in natural gas processing systems.

SUMMARY OF THE INVENTION

The above and other objects, which will become apparent to those skilled in the art upon a reading of this disclosure, are attained by the present invention, one aspect of which is:

A method for producing liquefied natural gas comprising:

(A) cooling a first natural gas stream to produce first cooled natural gas, and expanding the first cooled natural gas to produce refrigeration bearing natural gas;

(B) cooling a second natural gas stream by indirect heat exchange with the refrigeration bearing natural gas to produce second cooled natural gas;

(C) compressing a mixed refrigerant fluid, cooling the compressed mixed refrigerant fluid, and expanding the cooled mixed refrigerant fluid to produce refrigeration bearing mixed refrigerant fluid;

(D) warming the refrigeration bearing mixed refrigerant fluid by indirect heat exchange with the cooling compressed mixed refrigerant fluid and by indirect heat exchange with second cooled natural gas to condense at least some of the second cooled natural gas; and (E) recovering resulting condensed natural gas as product liquefied natural gas.

Another aspect of the invention is:

A method for producing liquefied industrial gas comprising:

(A) cooling a natural gas stream to produce cooled natural gas, and expanding the cooled natural gas to produce refrigeration bearing natural gas;

(B) cooling an industrial gas stream by indirect heat exchange with the refrigeration bearing natural gas to produce cooled industrial gas;

(C) compressing a mixed refrigerant fluid, cooling the compressed mixed refrigerant fluid, and expanding the cooled mixed refrigerant fluid to produce refrigeration bearing mixed refrigerant fluid;

(D) warming the refrigeration bearing mixed refrigerant fluid by indirect heat exchange with the cooling compressed mixed refrigerant fluid and by indirect heat exchange with cooled industrial gas to condense at least some of the cooled industrial gas; and (E) recovering resulting condensed industrial gas as product liquefied industrial gas.

As used herein the term "subcooling" means cooling a liquid to be at a temperature lower than the saturation temperature of that liquid for the existing pressure.

As used herein the term "indirect heat exchange" means the bringing of fluids into heat exchange relation without any physical contact or intermixing of the fluids with each other.

As used herein the terms "turboexpansion" and "turboexpander" means respectively method and apparatus for the flow of high pressure fluid through a turbine to reduce the pressure and the temperature of the fluid thereby generating refrigeration.

As used herein the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the variable load refrigerant is at least 10° K, preferably at least 20° K and most preferably at least 50° K.

As used herein the term "industrial gas" means a fluid having a normal boiling point of 150° K or less. Examples of industrial gases include nitrogen, oxygen, argon, hydrogen, helium, neon and fluid mixtures containing one or more thereof.

As used herein the term "natural gas" means a fluid comprised of at least 45 mole percent methane.

DETAILED DESCRIPTION

In general the invention gainfully employs the pressure energy of a natural gas processing system by using the pressure energy to generate refrigeration and using that refrigeration to supply high temperature cooling to a gas, and using a mixed refrigerant fluid to generate refrigeration for low temperature cooling of the gas to condense the gas and produce liquefied product.

Figure 1:
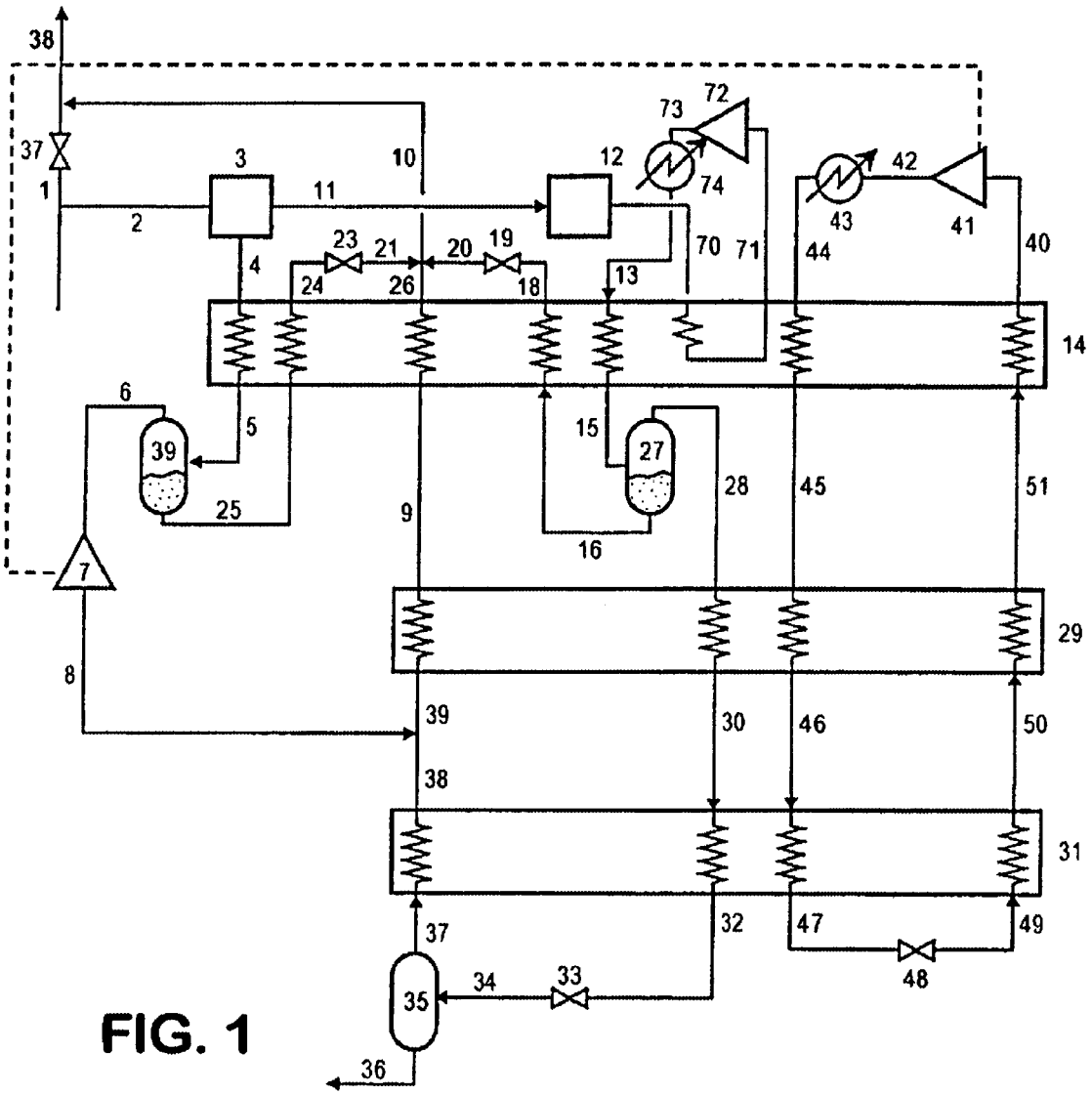
FIG. 1 is a schematic representation of one preferred embodiment of the invention wherein the product is liquefied natural gas.

The invention will be described in greater detail with reference to the Drawings. Referring now to FIG. 1, a natural gas stream 2 taken, for example from natural gas pipeline stream 1, is passed to dryer 3 wherein water vapor is removed. Typically the pressure of natural gas stream 2 is within the range of from 200 to 1000 psig. If desired, natural gas stream 2 can also undergo carbon dioxide removal in addition to water vapor removal. The major fraction 4 of resulting natural gas stream from dryer 3 is passed as a first natural gas stream to main or high temperature heat exchanger 14 wherein it is cooled and partially condensed. The resulting natural gas stream 5 is passed from main heat exchanger 14 to phase separator 39 wherein it is separated into vapor and liquid fractions. Liquid natural gas stream 25 is passed from phase separator 39 to heat exchanger 14 wherein it is warmed and vaporized, and then passed as stream 24 through valve 23 and as stream 21 is combined with other streams to form stream 10 as will be more fully described below. The remaining vapor of the cooled first natural gas stream is passed in stream 6 from phase separator 39 to an expansion device, which in the embodiment of the invention illustrated in FIG. 1 is turboexpander 7, wherein it is expanded to a pressure generally within the-range of from 40 to 80 pounds per square inch absolute (psia) thereby generating refrigeration. Resulting refrigeration bearing natural gas is passed out from turboexpander 7 in stream 8 and is used for cooling purposes as will be described more fully below.

A minor fraction 11 of the dried natural gas from dryer 3 is passed as a second natural gas stream to carbon dioxide removal system 12 wherein it is cleaned, or further cleaned, of carbon dioxide. If desired, stream 11 may be compressed to a higher pressure prior to passage to carbon dioxide removal system 12. Typically both dryer 3 and carbon dioxide removal system 12 employ molecular sieve adsorbents to clean the natural gas of water vapor and/or carbon dioxide. In the embodiment of the invention illustrated in FIG. 1, the second natural gas stream from carbon dioxide removal unit 12 is passed in stream 70 for cooling in heat exchanger 14 and then passed in stream 71 to compressor 72 for production of high pressure stream 73, which is cooled in cooler 74 and then passed in stream 13 to main heat exchanger 14. Within main heat exchanger 14 the second natural gas stream in stream 13 is cooled and partially condensed by indirect heat exchange with the aforesaid refrigeration bearing natural gas and is withdrawn from main heat exchanger 14 in stream 15. Typically the cooled natural gas in stream 15 has a temperature within the range of from 150 to 260 K.

Stream 15 is passed from main heat exchanger 14 to phase separator 27 wherein it is separated into vapor and liquid fractions. Liquid natural gas stream 16 is passed from phase separator 27 to heat exchanger 14 wherein it is warmed and vaporized, and then passed as stream 18 through valve 19 and as stream 20 is combined with other streams to form stream 10. The remaining vapor from stream 15 is withdrawn from phase separator 27 as stream 28 and is cooled, and may be partially condensed by passage through intermediate heat exchanger 29 by indirect heat exchange with the aforesaid warming refrigeration bearing natural gas and also with warming refrigeration bearing mixed refrigerant fluid which will be described more fully below. The resulting second cooled natural gas in stream 30 is passed to cold heat exchanger 31 wherein it is at last partially condensed, preferably is fully condensed and, most preferably, is subcooled, by indirect heat exchange with warming mixed refrigerant fluid to produce at least partially condensed natural gas stream 32. Typically the temperature of natural gas 32 is within the range of from 100 to 170 K, preferably within the range of from 110 to 140 K.

The lower level cooling and liquefaction of the natural gas is generated by a single circuit mixed refrigerant fluid refrigeration system. The mixed refrigerant fluid useful in the practice of this invention preferable comprises at least two components from the group consisting of fluorocarbons, hydrofluorocarbons, hydrochlorofluorocarbons, fluoroethers, hydrofluoroethers, atmospheric gases and hydrocarbons. Preferably the mixed refrigerant fluid useful in the practice of this invention is a variable load refrigerant.

The mixed refrigerant useful with this invention preferably comprises at least one component from the group consisting of fluorocarbons, hydrofluorocarbons, fluoroethers and hydrofluoroethers, and at least one component from the group consisting of fluorocarbons, hydrofluorocarbons, hydrochlorofluorocarbons, fluoroethers and hydrofluoroethers, and atmospheric gases and hydrocarbons.

Another preferred mixed refrigerant useful with this invention comprises at least two hydrofluorocarbons, hydrochlorofluorocarbons, fluoroethers, hydrofluoroethers, hydrocarbons and/or atmospheric gases.

Another preferred mixed refrigerant useful with this invention comprises at least one fluorocarbon and at least one component from the group consisting of hydrofluorocarbons and atmospheric gases.

Another preferred mixed refrigerant useful with this invention comprises at least one hydrofluorocarbon and at least one atmospheric gas.

Another preferred mixed refrigerant useful with this invention comprises at least three components from the group consisting of fluorocarbons, hydrofluorocarbons, fluoroethers and hydrofluoroethers, and at least one component from the group consisting of fluorocarbons, hydrofluorocarbons, hydrochlorofluorocarbons, fluoroethers, hydrofluoroethers, hydrocarbons and atmospheric gases.

Another preferred mixed refrigerant useful with this invention comprises at least two components from the group consisting of fluorocarbons, hydrofluorocarbons, fluoroethers and hydrofluoroethers, and at least one atmospheric gas.

Another preferred mixed refrigerant useful with this invention comprises two or more hydrocarbons.

Another preferred mixed refrigerant useful with this invention comprises two or more hydrocarbons and one or more atmospheric gases.

Another preferred mixed refrigerant useful with this invention comprises at least two components from the group consisting of fluorocarbons, hydrofluorocarbons, fluoroethers and hydrofluoroethers, at least one atmospheric gas, and at least one component from the group consisting of fluorocarbons, hydrofluorocarbons, hydrochlorofluorocarbons, fluoroethers, hydrofluoroethers, hydrocarbons and atmospheric gases.

Another preferred mixed refrigerant useful with this invention comprises at least two components from the group consisting of fluorocarbons, hydrofluorocarbons, fluoroethers and hydrofluoroethers, and at least two atmospheric gases.

Another preferred mixed refrigerant useful with this invention includes at least one fluoroether, i.e. comprises at least one fluoroether, and at least one component from the group consisting of fluorocarbons, hydrofluorocarbons, fluoroethers, hydrofluoroethers, hydrochlorofluorocarbons, hydrocarbons and atmospheric gases.

In one preferred embodiment of the invention the mixed refrigerant consists solely of fluorocarbons. In another preferred embodiment of the invention the mixed refrigerant consists solely of fluorocarbons and hydrofluorocarbons. In another preferred embodiment of the invention the mixed refrigerant consists solely of fluoroethers. In another preferred embodiment of the invention the mixed refrigerant consists solely of fluoroethers and hydrofluoroethers. In another preferred embodiment of the invention the mixed refrigerant consists solely of fluorocarbons, hydrofluorocarbons, fluoroethers and hydrofluoroethers. In another preferred embodiment of the invention the mixed refrigerant consists solely of fluorocarbons, fluoroethers and atmospheric gases. Most preferably every component of the mixed refrigerant is either a fluorocarbon, hydrofluorocarbon, fluoroether, hydrofluoroether or atmospheric gas.

Referring back now to FIG. 1, mixed refrigerant fluid 40, preferably at a pressure within the range of from 40 to 100 psia, most preferably at a pressure within the range of from 60 to 90 psia, is compressed by passage through compressor 41 to a pressure preferably within the range of from 80 to 350 psia, most preferably within the range of from 150 to 250 psia. Resulting refrigerant stream 42 from compressor 41 is cooled by passage through cooler 43, typically by indirect heat exchange with cooling water or air, emerging therefrom as refrigerant stream 44, generally at about ambient temperature.

Multicomponent refrigerant stream 44 is passed through main heat exchanger 14 wherein it is further cooled. Resulting mixed refrigerant fluid withdrawn from heat exchanger 14 in stream 45 is further cooled by passage through heat exchanger 29 to form stream 46 which is then passed to heat exchanger 31 wherein it is further cooled and at least partially condensed emerging therefrom as refrigerant stream 47 having a temperature typically within the range of from 100 to 170 K, preferably within the range of from 110 to 140 K.

Mixed refrigerant fluid in stream 47 is expanded through an expansion device such as Joule-Thomson valve 48 to generate refrigeration and resulting refrigeration bearing mixed refrigerant fluid in stream 49 is then warmed and vaporized to provide refrigeration to effect the cooling and liquefaction of the natural gas as well as the mixed refrigerant fluid in the cooling leg of the refrigeration circuit. In the embodiment of the invention illustrated in FIG. 1, stream 49, which typically contains a vapor portion, is warmed and further vaporized by passage through heat exchanger 31 to form stream 50 which is warmed and further vaporized by passage through heat exchanger 29 to form stream 51. Stream 51 is passed through main heat exchanger 14 wherein it is warmed and any remaining liquid portion, if any, is vaporized, emerging therefrom as mixed refrigerant fluid vapor stream 40. Stream 40 is passed to compressor 41, the refrigeration circuit is completed and the cycle begins anew.

As illustrated in FIG. 1 by the dotted line, preferably at least some and most preferably all of the power to operate compressor 41 of the mixed gas refrigeration circuit is provided by work generated by the expansion of the first cooled natural gas to produce the refrigeration bearing natural gas. Alternatively to the Joule-Thomson expansion 48 of the embodiment illustrated in FIG. 1, the expansion of the cooled mixed refrigerant fluid could be by turboexpansion through a turboexpander to produce the refrigeration bearing mixed refrigerant fluid.

Referring back now to FIG. 1, the at least partially condensed second natural gas stream 32 is passed through valve 33 and as two phase stream 34 is passed into phase separator 35. Liquid from phase separator 35 is withdrawn in stream 36 and recovered as product liquefied natural gas. Vapor from phase separator 35 is withdrawn in stream 37 and warmed by passage through cold heat exchanger 31, emerging therefrom in stream 38. In the embodiment of the invention illustrated in FIG. 1, stream 38 is combined with refrigeration bearing natural gas stream 8 to form stream 39 for passage together through intermediate heat exchanger 29 and main or warm heat exchanger 14. Alternatively natural gas stream 38 and refrigeration bearing natural gas stream 8 could pass separately through heat exchangers 29 and 14. In the embodiment illustrated in FIG. 1, combined stream 39 is warmed by indirect heat exchange in heat exchanger 29 emerging therefrom as stream 9 which is warmed by indirect heat exchange in heat exchanger 14 thereby effecting the higher level cooling of the second natural gas stream. The resulting warmed natural gas is withdrawn from heat exchanger 14 in stream 26 which is combined with the aforementioned streams 21 and 20 to form stream 10. Natural gas stream 10, as illustrated in FIG. 1, may be returned to the natural gas pipeline stream, downstream of valve 37 to form natural gas pipeline stream 38.

Figure 2:
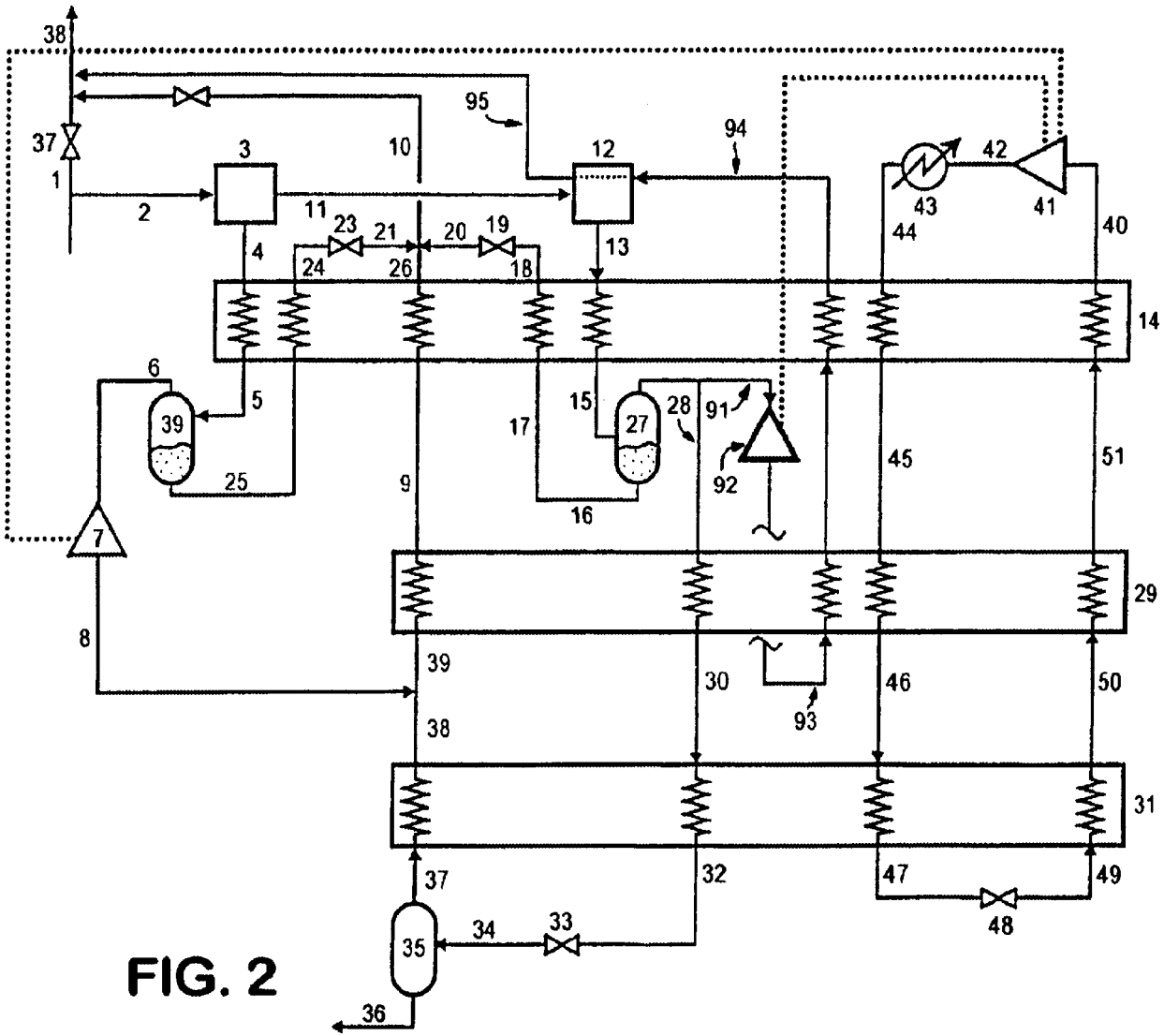
FIG. 2 is a schematic representation of another preferred embodiment of the invention wherein the product is liquefied natural gas.

FIG. 2 illustrates another embodiment of the invention wherein the product is liquefied natural gas. The numerals in FIG. 2 are the same as those of FIG. 1 for the common elements and these common elements will not be described again in detail.

Referring now to FIG. 2 the second natural gas stream from carbon dioxide removal unit 12 is passed directly as stream 13 to main heat exchanger 14, emerging therefrom as cooled natural gas stream 15. A portion of the vapor from phase separator 27, identified as stream 91 is turboexpanded through turboexpander 92 to generate refrigeration and resulting refrigeration bearing natural gas stream 93 is warmed by passage through heat exchangers 29 and 14 to provide refrigeration for some of the cooling of the first natural gas stream, the second natural gas stream and/or the compressed mixed refrigerant fluid. The resulting warmed natural gas stream 94 is used to clean unit 12 by uptaking carbon dioxide which had been previously adsorbed therein, and the resulting carbon dioxide containing natural gas stream 95 is returned to the natural gas pipeline stream. As shown by the dotted line, some of the power to operate compressor 41 of the mixed gas refrigeration circuit is provided by work generated by the expansion of natural gas portion 91 in turboexpander 92.

Figure 3:
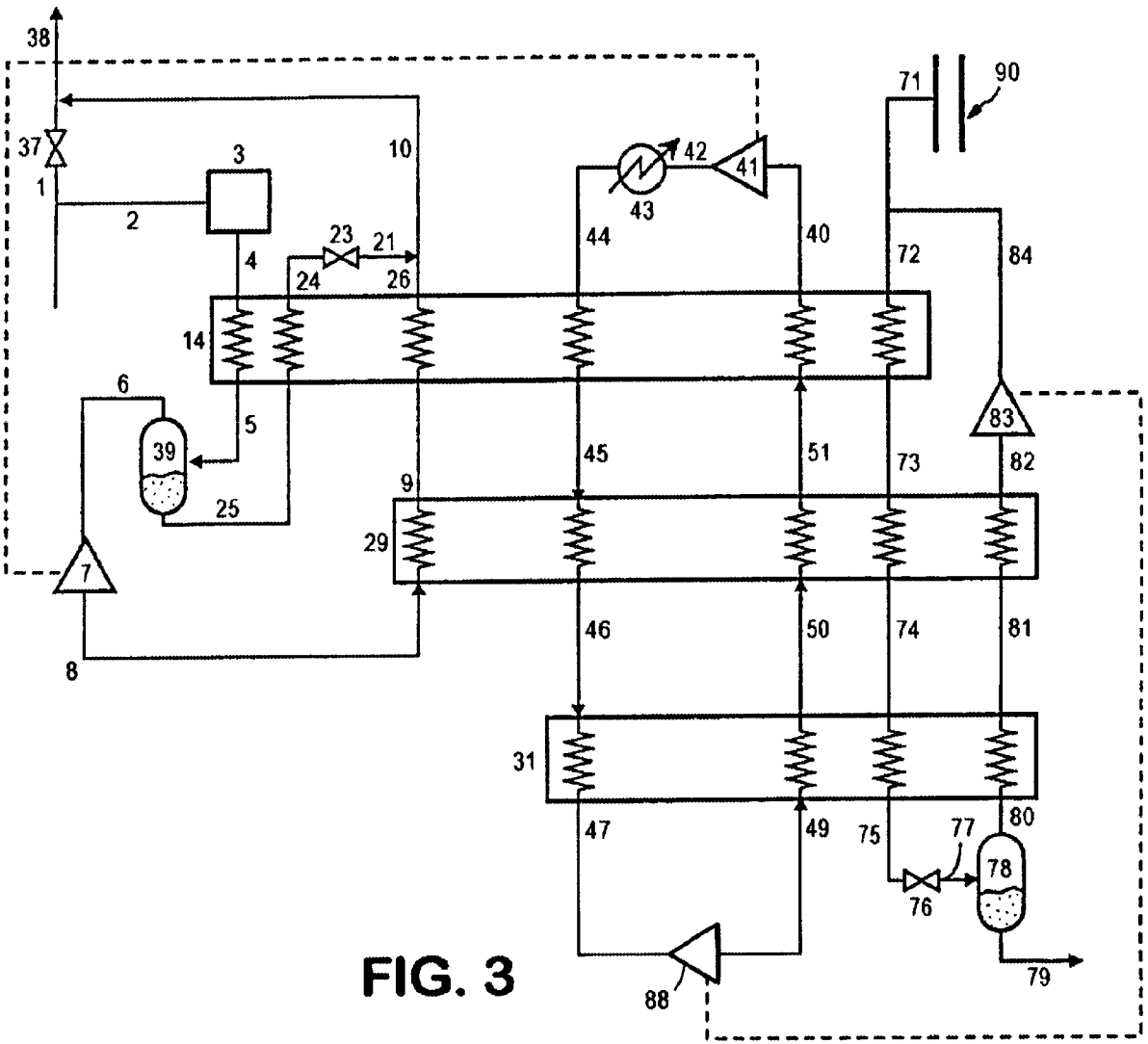
FIG. 3 is a schematic representation of a preferred embodiment of the invention wherein the product is liquefied industrial gas.

FIG. 3 illustrates another embodiment of the invention wherein the product is liquefied industrial gas. The numerals in FIG. 3 are the same as those of FIG. 1 for the common elements and these common elements will not be described again in detail. In the embodiment illustrated in FIG. 3 the entire amount of the dried natural gas is passed out from drier 3 in stream 4 to ultimately form the refrigeration bearing natural gas 8 for passage through intermediate heat exchanger 29 and high level or warm heat exchanger 14. Also in the embodiment illustrated in FIG. 3, the expansion device used in the mixed gas refrigerant circuit is a turboexpander 88 although, of course, a Joule-Thomson valve may also be used. As represented by the dotted line, at least some and preferably all of the power to drive the compressor 83 of the industrial gas liquefaction circuit is provided by the work generated by turboexpander 88.

Referring now to FIG. 3, industrial gas 71, e.g. nitrogen, from an industrial gas source such as nitrogen pipeline 90, is combined with stream 84 from compressor 83 to form stream 72. Industrial gas stream 72 is cooled by passage through high level or warm heat exchanger 14 and as stream 73 is passed to intermediate heat exchanger 29 wherein it is cooled to produce cooled industrial gas 74. In heat exchangers 14 and 29 the industrial gas is cooled by indirect heat exchange with warming refrigeration bearing natural gas and also with warming refrigeration bearing mixed refrigerant fluid. Typically the temperature of the cooled industrial gas in stream 74 is within the range of from 140 to 180 K.

Cooled industrial gas 74 is passed to cold heat exchanger 31 wherein it is at least partially condensed and may be totally condensed and even subcooled by indirect heat exchange with warming refrigeration bearing mixed refrigerant fluid. Resulting industrial gas 75 which is at least partially and may be totally in the liquid phase, and generally has a temperature within the range of from 80 to 120 K, is passed through valve 76 and as stream 77 into phase separator 78 wherein it is separated into vapor and liquid fractions. Liquid is withdrawn in stream 79 from phase separator 78 and recovered as product liquefied industrial gas, e.g. liquid nitrogen. Vapor is withdrawn from phase separator 78 in stream 80, warmed by passage through cold heat exchanger 31, and as stream 81, warmed by passage through intermediate heat exchanger 29, emerging therefrom as stream 82 for passage to compressor 83 for generation of aforesaid stream 84.

Although the invention has been described in detail with reference to certain preferred embodiments, those skilled in the art will recognize that there are other embodiments within the spirit and the scope of the claims. For example, two or more of the heat exchangers used in the practice of this invention could be combined into a single unit in place of the separate heat exchangers illustrated in the Drawings.

What is claimed is:

1. A method for producing liquefied natural gas comprising:

(A) cooling a first natural gas stream to produce first cooled natural gas, and expanding the first cooled natural gas to produce refrigeration bearing natural gas;

(B) cooling a second natural gas stream by indirect heat exchange with the refrigeration bearing natural gas to produce second cooled natural gas;

(C) compressing a mixed refrigerant fluid, cooling the compressed mixed refrigerant fluid, and expanding the cooled mixed refrigerant fluid to produce refrigeration bearing mixed refrigerant fluid;

(D) warming the refrigeration bearing mixed refrigerant fluid by indirect heat exchange with the cooling compressed mixed refrigerant fluid and by indirect heat exchange with second cooled natural gas to condense at least some of the second cooled natural gas; and (E) recovering resulting condensed natural gas as product liquefied natural gas, wherein at least some of the power for compressing the mixed refrigerant fluid is provided from expanding the first cooled natural gas to produce the refrigeration bearing natural gas.

2. The method of claim 1 wherein both the first natural gas stream and the second natural gas stream are taken from a natural gas pipeline.

3. The method of claim 1 wherein the cooling of the first natural gas stream produces a vapor and a liquid fraction, and the vapor fraction is expanded to produce the refrigeration bearing natural gas.

4. The method of claim 3 wherein the liquid fraction is vaporized and then recovered.

5. The method of claim 1 wherein the second natural gas stream undergoes a carbon dioxide removal step prior to said cooling.

6. The method of claim 1 wherein a portion of the second cooled natural gas is turboexpanded and then warmed to provide some cooling for at least one of the first natural gas stream, the second natural gas stream and the compressed mixed refrigerant fluid.

7. The method or claim 6 wherein some of the power for compressing the mixed refrigerant fluid is provided by the turboexpansion of the second cooled natural gas portion.

8. A method for producing liquefied natural gas comprising:

(A) cooling a first natural gas stream to produce first cooled natural gas, and expanding the first cooled natural gas to produce refrigeration bearing natural gas;

(B) cooling a second natural gas stream by indirect heat exchange with the refrigeration bearing natural gas to produce second cooled natural gas;

(C) compressing a mixed refrigerant fluid, cooling the compressed mixed refrigerant fluid, and expanding the cooled mixed refrigerant fluid to produce refrigeration bearing mixed refrigerant fluid;

(D) warming the refrigeration bearing mixed refrigerant fluid by indirect heat exchange with the cooling compressed mixed refrigerant fluid and by indirect heat exchange with second cooled natural gas to condense at least some of the second cooled natural gas; and (E) recovering resulting condensed natural gas as product liquefied natural gas, wherein the cooling of the first natural gas stream produces a vapor and a liquid fraction, and the vapor fraction is expanded to produce the refrigeration bearing natural gas.

9. The method of claim 8 wherein both the first natural gas stream and the second natural gas stream are taken from a natural gas pipeline.

10. The method of claim 8 wherein the liquid fraction is vaporized and then recovered.

11. The method of claim 8 wherein the second natural gas stream undergoes a carbon dioxide removal step prior to said cooling.

12. The method of claim 8 wherein a portion of the second cooled natural gas is turboexpanded and then warmed to provide some cooling for at least one of the first natural gas stream, the second natural gas stream and the compressed mixed refrigerant fluid.

13. The method of claim 12 wherein some of the power for compressing the mixed refrigerant fluid is provided by the turboexpansion of the second cooled natural gas portion.

14. A method for producing liquefied natural gas comprising:

(A) cooling a first natural gas stream to produce first cooled natural gas, and expanding the first cooled natural gas to produce refrigeration bearing natural gas;

(B) cooling a second natural gas stream by indirect heat exchange with the refrigeration bearing natural gas to produce second cooled natural gas;

(C) compressing a mixed refrigerant fluid, cooling the compressed mixed refrigerant fluid, and expanding the cooled mixed refrigerant fluid to produce refrigeration bearing mixed refrigerant fluid;

(D) warming the refrigeration bearing mixed refrigerant fluid by indirect heat exchange with the cooling compressed mixed refrigerant fluid and by indirect heat exchange with second cooled natural gas to condense at least some of the second cooled natural gas; and (E) recovering resulting condensed natural gas as product liquefied natural gas, wherein a portion of the second cooled natural gas is turboexpanded and then warmed to provide some cooling for at least one of the first natural gas stream, the second natural gas stream and the compressed mixed refrigerant fluid.

15. The method of claim 14 wherein both the first natural gas stream and the second natural gas stream are taken from a natural gas pipeline.

16. The method of claim 14 wherein the second natural gas stream undergoes a carbon dioxide removal step prior to said cooling.

17. The method of claim 14 wherein some of the power for compressing the mixed refrigerant fluid is provided by the turboexpansion of the second cooled natural gas portion.

* * * * *